US007369674B2

(12) United States Patent
Miura

(10) Patent No.: US 7,369,674 B2
(45) Date of Patent: May 6, 2008

(54) ACOUSTIC APPARATUS

(75) Inventor: Naoki Miura, Fujikawaguchiko-machi (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 415 days.

(21) Appl. No.: 10/989,558

(22) Filed: Nov. 17, 2004

(65) Prior Publication Data

US 2005/0180592 A1 Aug. 18, 2005

(30) Foreign Application Priority Data

Nov. 20, 2003 (JP) ..... P2003-391518

(51) Int. Cl.
*H04R 25/00* (2006.01)

(52) U.S. Cl. ..... 381/401; 381/396; 381/398

(58) Field of Classification Search ..... 381/401, 381/412, 152, 182, 184, 402, 398, 396, 417, 381/421, 306, 333, 386, 388, 391, 189, 400, 381/403, 424, 431, 186; 379/433.01, 433.02
See application file for complete search history.

(56) References Cited

U.S. PATENT DOCUMENTS 6,385,328 B1 * 5/2002 Yoo et al. ..... 381/412
6,553,125 B2 * 4/2003 Kobayashi et al. ..... 381/396
6,618,487 B1 * 9/2003 Azima et al. ..... 381/152
6,741,721 B2 * 5/2004 Fukawatase et al. ..... 381/401
6,744,895 B2 * 6/2004 Miyamoto et al. ..... 381/182
6,754,363 B2 * 6/2004 Chang ..... 381/401
6,807,282 B2 * 10/2004 Kaneda et al. ..... 381/396
7,106,881 B2 * 9/2006 Backman ..... 381/408
2001/0017922 A1 * 8/2001 Kim ..... 381/150
2001/0017930 A1 * 8/2001 Matsudo et al. ..... 381/412
2001/0026625 A1 * 10/2001 Azima et al. ..... 381/152
2002/0051557 A1 * 5/2002 Kobayashi et al. ..... 381/401
2003/0219140 A1 * 11/2003 Choi ..... 381/412
2004/0125981 A1 * 7/2004 Furuya ..... 381/423
2005/0276427 A1 * 12/2005 Kam ..... 381/152
2006/0002578 A1 * 1/2006 Kim et al. ..... 381/396

FOREIGN PATENT DOCUMENTS

JP 2002-335597 11/2002
JP 2003-102093 4/2003

* cited by examiner

*Primary Examiner*—Huyen Le
(74) *Attorney, Agent, or Firm*—Browdy and Neimark

(57) ABSTRACT

An acoustic apparatus comprising a yoke, a main speaker mechanism disposed on a first surface of the yoke, and a sub speaker mechanism disposed on a second surface of the yoke opposite to the first surface and adjacent to the main speaker mechanism, the main speaker mechanism including a first magnet disposed on the first surface of the yoke, a first top plate disposed on the first magnet, a vibration-transmitting panel attached to the yoke and contactable with a vibrating member in a communication device, and a first voice coil attached to the vibration-transmitting panel and inserted in a first magnetic gap formed between the yoke and the first magnet, the sub speaker mechanism including a second magnet disposed on the second surface of the yoke, a second top plate disposed on the second magnet, a vibrating plate attached to a frame disposed to surround the yoke and a second voice coil attached to the vibrating plate and inserted in a second magnetic gap formed between the yoke and the second magnet.

8 Claims, 5 Drawing Sheets

ACOUSTIC APPARATUS

CROSS-REFERENCE TO THE RELATED APPLICATION

The application claims the priority benefit of Japanese Patent Application No. 2003-391518, filed on Nov. 20, 2003, the entire descriptions of which are incorporated herein by reference.

BACKGROUND OF THE INVENTION

1. Field of the Invention

The present invention relates to an acoustic apparatus suitable for communication devices such as a mobile phone, portable television, and computers.

2. Description of Related Art

Conventionally, an acoustic outputting apparatus for a mobile phone is composed of two speakers in general. One example of such a conventional mobile phone is described referring to FIG. 5A to 5C. In FIGS. 5A to 5C, the mobile phone 51 has a display 51*a*, an operational part 51*b*, and a liquid crystal display 52, which is disposed on a front surface of the display 51*a* and corresponds to an image plane. Numeral 53 denotes a speaker for talking, which is disposed on the front surface of the display 51*a* outside of an area of the liquid crystal display 52, and releases a sound through sound-releasing holes 54 opening in the front surface of the display 51*a*. Numeral 55 denotes a mainly ringing speaker, which is disposed on a back surface of the display 51*a* in accordance with augmentation of the liquid crystal display and releases a sound through sound-releasing holes 56 opening in the back surface.

There is known a complex speaker in which an outer magnetic-type circuit and an inner magnetic-type circuit are structured into one frame (for reference, see JP2002-335597, [0010] to [0013], FIG. 1).

However, because the conventional mobile phone as described above has a structure hearing a sound from the speaker remote from the image plane in the back surface of the mobile phone while watching an image on the front surface of the mobile phone and the sound hears from a position remote from the image, there are problems that matching effect of sound and image is not acquired, a loss of acoustic pressure and a drop of treble occur, and acoustic re-producing ability which ordinary speakers have in themselves is not acquired. In the speaker having the structure disclosed in the above-mentioned patent document, because a thickness of a film as a vibrating plate is thinner, there are problems that it has a boundary for an output of the receiver, is suitable for a talking speaker, but cannot respond to a large output as a speaker aimed at a call waiting tone or beep.

There is known an acoustic apparatus having a sub speaker mechanism and a receiver mechanism disposed adjacent to each other (for reference, see Japanese Patent Laid-Open 2003-102093).

However, in the conventional acoustic apparatus, a vibrating plate and a protector for protecting the vibrating plate are required for both speaker and receiver mechanisms. This results in an acoustic apparatus having a great thickness.

SUMMARY OF THE INVENTION

The present invention has been made in view of the above problems and an object thereof is to provide an acoustic apparatus having good acoustic characteristics and capable of obtaining matching effect of sound and image.

To accomplish the above object, an acoustic apparatus in an aspect of the present invention comprises a yoke, a main speaker mechanism disposed on a first surface of the yoke, and a sub speaker mechanism disposed on a second surface of the yoke opposite to the first surface.

The main speaker mechanism includes a first magnet disposed on the first surface of the yoke, a first top plate disposed on the first magnet, a vibration-transmitting panel attached to the yoke, and a first voice coil attached to the vibration-transmitting panel and inserted in a first magnetic gap formed between the yoke and the first magnet. The vibration-transmitting panel is contactable with a vibrating member which is a transparent plate to cover a liquid crystal display of a communication device in which the acoustic apparatus is installed.

The sub speaker mechanism includes a second magnet disposed on the second surface of the yoke, a second top plate disposed on the second magnet, a vibrating plate attached to a frame disposed to surround the yoke and a second voice coil attached to the vibrating plate and inserted in a second magnetic gap formed between the yoke and the second magnet.

DETAILED DESCRIPTION OF THE PREFERRED EMBODIMENTS

Some embodiments of the present invention will be explained with reference to the accompanying drawings below.

Figure 1:
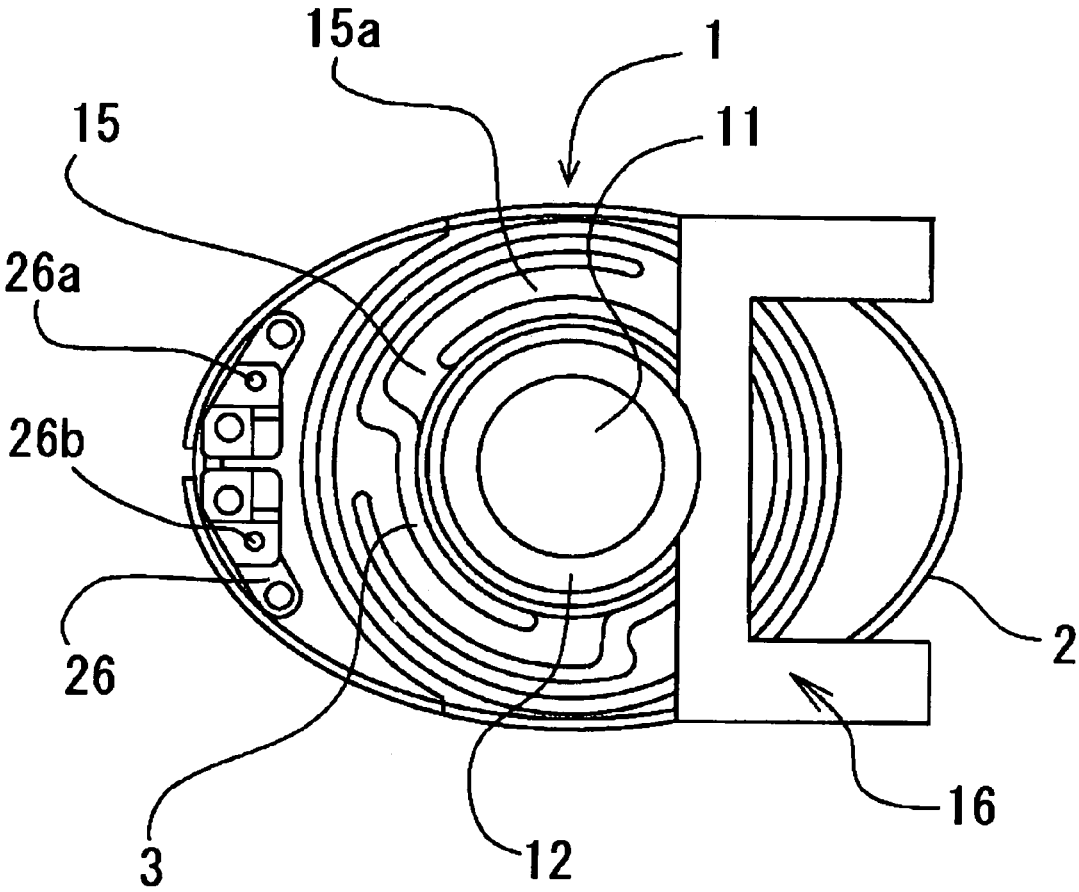
FIG. 1 is a plan view showing an acoustic apparatus according to the present invention.
Figure 2:
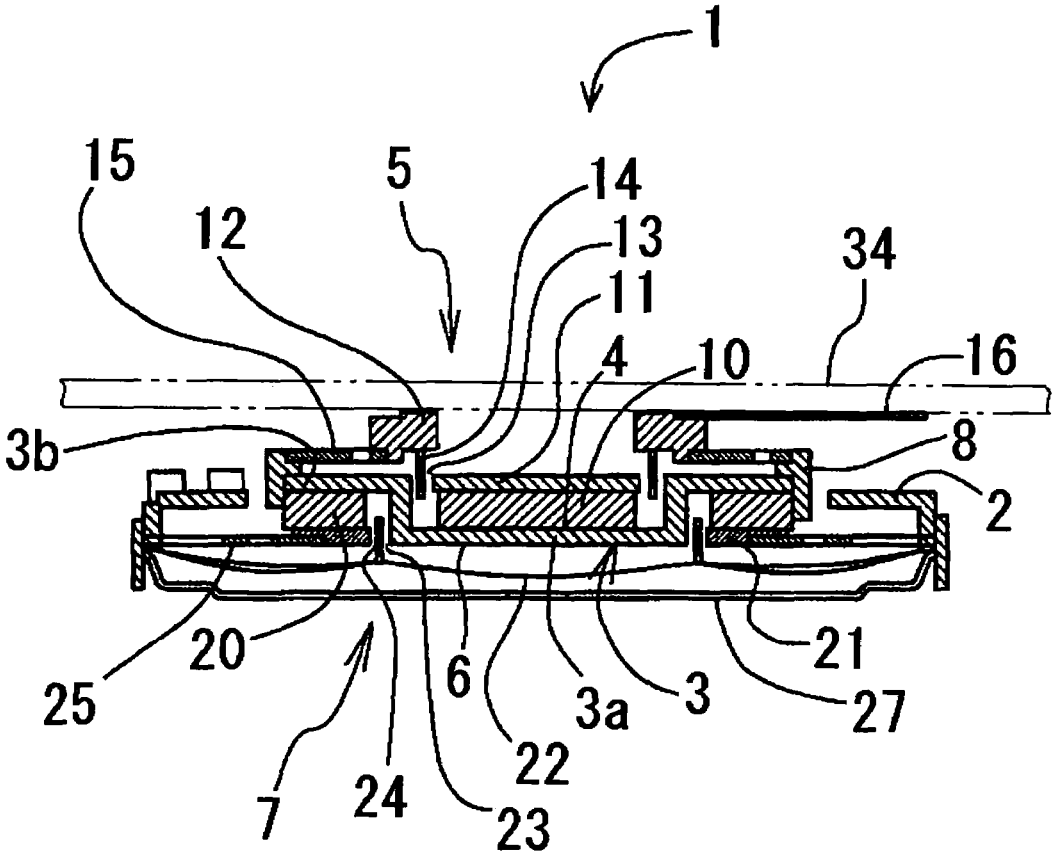
FIG. 2 is a sectional view of the acoustic apparatus shown in FIG. 1.
Figure 3:
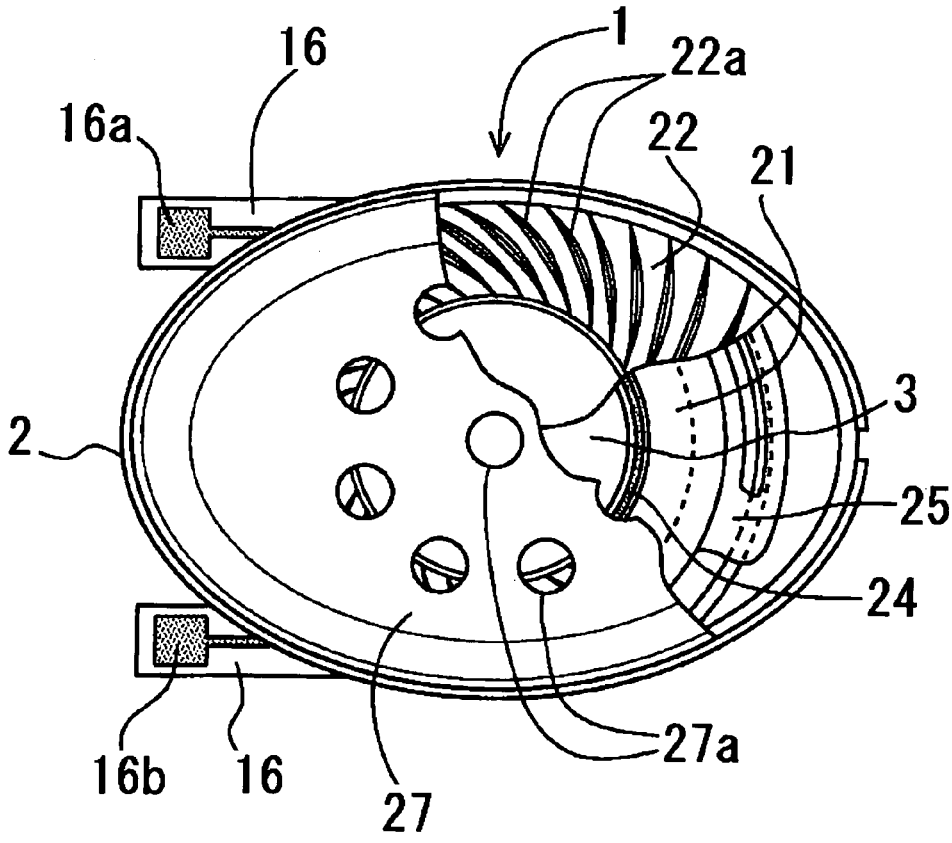
FIG. 3 is a rear view of the acoustic apparatus shown in FIG. 1.

One embodiment of an acoustic apparatus according to the present invention is illustrated in FIGS. 1 to 3. The acoustic apparatus 1 has both functions to work as an actuator and as a speaker adapted to use suitably for, for example, a communication device such as a mobile phone or mobile terminal.

The acoustic apparatus 1 comprises a frame 2, a yoke 3 disposed inside of the frame 2, a main speaker mechanism 5 disposed on a first surface 4 of the yoke 3, and a sub speaker mechanism 7 which is disposed on a second surface 6 of the yoke 3 opposite to the first surface 4 adjacent to the main speaker mechanism 5 and integrally with it.

The main speaker mechanism 5 of an acoustic apparatus has functions of reproducing any type of sound such as TV sounds, game sounds, music, ringing tone, and talking voice as a receiver. Therefore, if the vibrating member which is a transparent plate to cover a liquid crystal display of a communication device is as large as a television screen size for home use for example, the acoustic apparatus attached to the transparent plate works well without a sub speaker, because the main speaker is attached to the large transparent plate which also works as a vibrating member of the acoustic apparatus and such a large vibrating member has enough power to reproduce any type of sound. However, if the acoustic apparatus is used in a portable communication device such as a mobile phone and the main speaker of the acoustic device is attached to a vibrating member which is a transparent plate to cover a liquid crystal display of the mobile phone for protection, the size of the transparent plate is sometimes too small to have enough power to reproduce any type of sound by using only the main speaker of the acoustic apparatus. If the acoustic apparatus is used in a small communication device, to reproduce sufficient level of sound, a sub speaker mechanism 7 is required. The sub speaker mechanism 7 also has functions of reproducing TV sounds, music, ringing tone, and talking voice as a receiver. If a flip phone is opened and used, the main speaker mechanism of the acoustic device used in the flip phone works mainly and the sub speaker mechanism works collaterally. If a flip phone is closed, the sub speaker works mainly. In addition, if the first surface 4 is set to an upper surface of the yoke 3 as viewed in FIG. 1, the second surface 6 is a lower surface of the yoke 3.

The frame 2 has a generally elliptic shape as viewed from plane as shown in FIG. 1 and an annular shape in section as shown in FIG. 2, in the embodiment. The frame 2 is made of a resin by forming, for example. The yoke 3 is made of a magnetic material and has a circular dish-like shape including a flat bottom wall 3*a* provided on a central portion thereof and a flange 3*b* provided on a circumference of the bottom wall 3*a*. In addition, an outer periphery of the flange 3*b* of the yoke 3 is attached to a sub-frame 8.

The main speaker mechanism 5 includes a first magnet 10 disposed on the yoke 3, concretely, the bottom wall 3*a* of the yoke 3, a first top plate 11 disposed on the first magnet 10, a vibration-transmitting panel 12 attached to the yoke 3, and a first voice coil 14 attached to the vibration-transmitting panel 12 and inserted in a first magnetic gap formed between the yoke 3 and the first magnet 10. Here, the first magnet 10 has a disc-like shape, the first top plate 11 is made of a magnetic material and has a disc-like shape.

A first magnetic circuit is formed by the yoke 3, the first magnet 10, the first top plate 11 and the first magnetic gap 13.

The vibration-transmitting panel 12 is formed by a generally annular member in the embodiment, and is fixed to an inner end of a first suspension 15. The first suspension 15 comprises, for example, three plate springs made of a material such as metal, resin, fiber and so on. The plate springs have arc-shaped arms 15*a* as shown in FIG. 1. An outer end of the first suspension 15 is fixed to an inner surface of the sub-frame 8. Consequently, the vibration-transmitting panel 12 is resiliently supported on the sub-frame 8 by the first suspension 15.

The first voice coil 14 comprises a coreless coil in which a winding is wound into a cylindrical shape, for example, and the first voice coil 14 is fixed at one end thereof to a lower surface of the vibration-transmitting panel 12 and inserted at the other end into the first magnetic gap 13.

A generally U-character shaped first circuit board 16 is fixed to the vibration-transmitting panel 12. The first circuit board 16 is provided with a pair of terminals 16*a* and 16*b* (see FIG. 3). Coil terminals of the first voice coil 14 are connected with the pair of terminals 16*a* and 16*b*, respectively.

The sub speaker mechanism 7 includes a second magnet 20 disposed on the yoke 3, a second top plate 21 attached on the second magnet 20, a vibrating plate 22 attached to the frame 2, and a second voice coil 24 attached to the vibrating plate 22 and inserted into a second magnetic gap 23 formed between the yoke 3 and the second magnet 20, as shown in FIGS. 2 and 3.

Here, a second magnetic circuit is formed by the yoke 3, the second magnet 20, the second top plate 21 and the second magnetic gap 23.

The second magnet 20 has an annular shape and connected with a lower surface of the flange 3*b*. A second suspension 25 is fixed at one end thereof to the second top plate 21 fixed on the second magnet 20 and fixed at the other end to the frame 2. More specifically, the second suspension 25 comprises a plate spring having an elliptical outer periphery and a circular inner periphery. The second suspension 25 is embedded at the outer periphery thereof into an elliptical outer peripheral portion of the frame 2, and connected at the inner periphery with the second top plate 21. The vibrating plate 22 is made of a resinous molding in the embodiment.

The second voice coil 24 comprises a coreless coil in which a winding is wound into a cylindrical shape, whose one end is connected on an upper surface of the vibrating plate 15, the other end thereof is inserted into the second magnetic gap 23. Meanwhile, a plurality of arc-shaped projecting bands 22*a* are radially formed on the vibrating plate 22 outside of the second voice coil 24 (see FIG. 3).

On the frame 2 is fixed a second circuit board 26, which has terminals 26*a* and 26*b*, as shown in FIG. 3. Coil terminals of the second voice coil 24 are connected with the terminals 26*a* and 26*b*.

A protector 27 is disposed so as to cover the vibrating plate 22. An outer periphery of the protector 27 is fixed to the elliptic portion of the frame 2 (see FIG. 2). The protector 27 is provided with a plurality of sound-releasing holes 27*a* (see FIG. 3).

Next, a method for mounting the acoustic apparatus 1 on the mobile phone will be explained referring to FIGS. 4A to 4C.

Figure 4A:
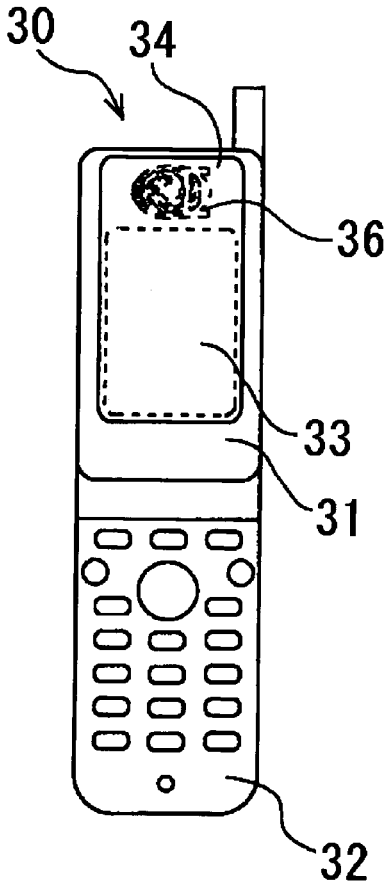
FIG. 4A is a front view showing a state in which an acoustic apparatus according to the present invention is installed in a mobile phone.
Figure 4B:
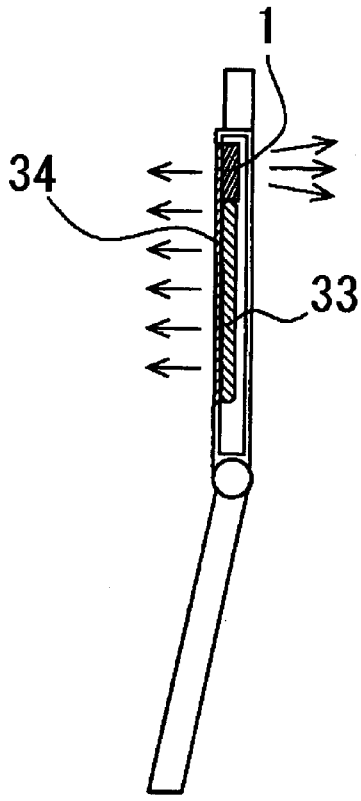
FIG. 4B is a side view of the mobile phone shown in FIG. 4A with a portion thereof sectioned.
Figure 4C:
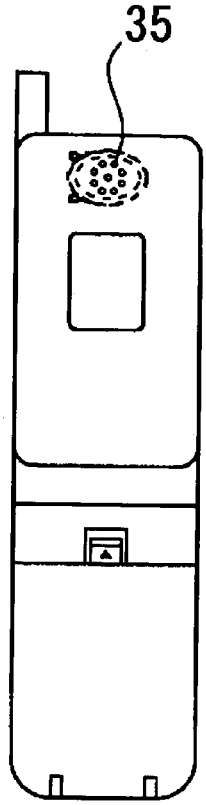
FIG. 4C is a rear view of the mobile phone shown in FIG. 4A.
Figure 5A:
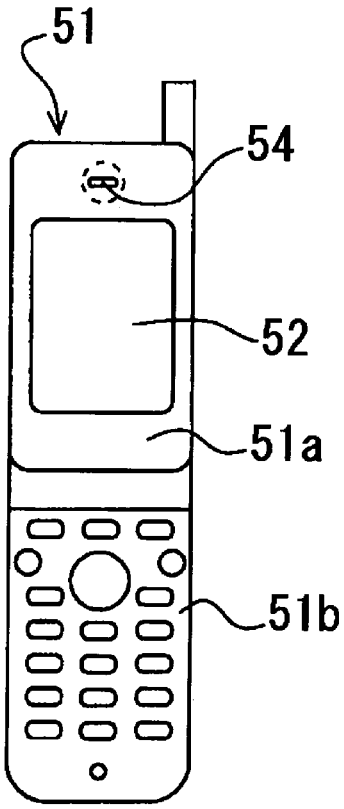
Fig. 5A (Prior Art)
FIG. 5A is a front view of a mobile phone in which a conventional acoustic apparatus is installed.
Figure 5B:
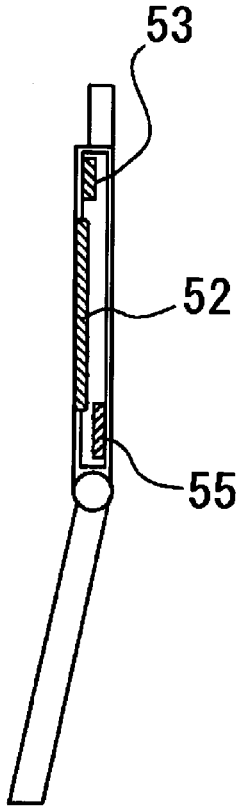
Fig. 5B (Prior Art)
FIG. 5B is a side view of the mobile phone shown in FIG. 5A with a portion thereof sectioned.
Figure 5C:
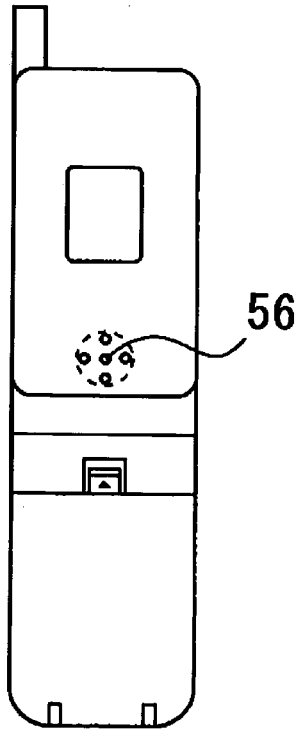
Fig. 5C (Prior Art)
FIG. 5C is a rear view of the mobile phone shown in FIG. 5A.

In FIGS. 4A to 4C, the mobile phone 30 comprises a displaying part 31 provided on a front surface of the mobile phone, an operational part 32, a liquid crystal display 33 provided on the displaying part 31, and a protecting transparent plate 34 which is made of a resin including acrylic resin and disposed to cover the liquid crystal display 33 to protect it. In FIG. 4C, reference numeral 35 denotes one or more sound-releasing holes formed in a back surface of the mobile phone 30. One or more suitable sound-releasing holes 36 are provided above the displaying part 31 to face to the sound-releasing holes 35. A sound from the main speaker mechanism 5 in the acoustic apparatus 1 is released from the sound-releasing holes 35, and a sound from the sub speaker mechanism 7 is released from the sound-releasing holes 36 through the sound-releasing holes 27*a*.

The acoustic apparatus 1 according to the present invention as described above is disposed in the displaying part 31. Here, the acoustic apparatus 1 is set so that the main speaker mechanism 5 disposed on the first surface 4 of the yoke 3 faces to the sound-releasing holes 35 formed in the back surface of the displaying part 31, in other words, the mobile phone 30 and the sub speaker mechanism 7 disposed on the second surface 6 of the yoke 3 faces to the sound-releasing holes 36 formed in the front surface of the mobile phone 30.

The vibration-transmitting panel 12 in the main speaker mechanism 5 is contacted or connected with, for example, the protecting transparent plate 34 of the mobile phone by use of a double-faced adhesive tape or sheet.

Next, a condition for using the mobile phone in which the acoustic apparatus 1 according to the present invention is installed will be explained.

When an acoustic driving signal is input from the terminals 16*a* and 16*b* of the first circuit board 16 into the first voice coil 14, in the acoustic apparatus 1, a relative displacement occurs between the first voice coil 14 and the yoke 3 by mutual interference of a magneto-motive force generated in the first voice coil 14 and a magnetic force of the first magnet 10. Because the first voice coil 14 is connected with the vibration-transmitting panel 12 supported resiliently on the frame 2 by the first suspension 15, the vibration-transmitting panel 12 is vibrated. The protecting transparent plate 34 to which the vibration of the vibration-transmitting panel 12 is transmitted, is vibrated, hence the main speaker mechanism 5 having an actuator function to oscillate the protecting transparent plate 34 provided to cover a liquid crystal display of a communication device or a mobile terminal shown in FIG. 4A for reproducing any type of sound such as TV sounds, music, game sound, ringing tone, and talking voice as a receiver and so on from the entire liquid crystal display is achieved. However, if the sound pressure is insufficient, the main speaker mechanism 5 works as a supporter for the sub speaker mechanism 7.

When an acoustic driving signal is input from the terminals 26*a* and 26*b* of the second circuit board 26 into the second voice coil 24, a relative displacement occurs between the second voice coil 24 and the yoke 3 by mutual interference of a magneto-motive force generated in the second voice coil 24 and a magnetic force of the second magnet 20. Because the second voice coil 24 is connected with the vibrating plate 22, the vibrating plate 22 supported resiliently on the frame 2 by the second suspension 25 is vibrated to release a speaker sound from the sound-releasing holes 27*a*. Thereby, a receiver function as a talking speaker for receiving a telephone is exercised in a normal arrival.

According to the present invention, if the acoustic apparatus 1 is installed in a communication device or a mobile terminal and the vibration-transmitting panel 12 is contacted or connected with the protecting transparent plate 34 provided on the front surface of the liquid crystal display 33, because a sound is released from the displaying part 31, it is possible to acquire good sound characteristics having matching effect of sound and image. Moreover, because the first and second magnetic circuits of the actuator and the speaker, in other words, the main and sub speaker mechanisms 5 and 7 are disposed adjacently to each other, the acoustic apparatus 1 can be miniaturized. Furthermore, because the terminals of the winding of the first voice coil 14 for the actuator are led out to exterior through the first circuit board 16 fixed to the vibration-transmitting panel 12, the winding is not subjected to a deformation for disconnecting the winding, and therefore a high reliability can be obtained.

According to the present invention, the main speaker mechanism disposed adjacent to the sub speaker mechanism has a structure in which any vibrating plate, in addition, a protector for protecting the vibrating plate are eliminated. Accordingly, a thinner acoustic apparatus can be accomplished.

The acoustic apparatus according to the present invention can be applied widely to the other communication or mobile information device such as a PDA, television, computer or the like, without being limited to the mobile phone.

Although the preferred embodiments of the present invention have been described, the present invention is not limited to the embodiments, various changes and modifications can be made to the embodiments, without departing the sprit of the present invention.

What is claimed is:

1. An acoustic apparatus, comprising:

a yoke including a central portion and a flange;

a main speaker mechanism having functions as a receiver and disposed on a first surface of the yoke;

a sub speaker mechanism having functions as a receiver and disposed on a second surface of the yoke opposite to the first surface and adjacent to the main speaker mechanism; and a frame disposed to surround the yoke and an outer periphery of the flange of the yoke being connected to a sub-frame positioned inside the frame, the main speaker mechanism including a first magnet disposed on the first surface of the yoke at the central portion thereof, a first top plate disposed on the first magnet, an annular vibration-transmitting panel connected to the sub-frame through a first suspension, and a first annular voice coil attached to a lower surface of the annular vibration-transmitting panel and inserted in a first magnetic gap formed between the yoke and the first magnet, the sub speaker mechanism including a second magnet which has an annular shape and is disposed on the second surface of the yoke at the flange thereof, a second top plate disposed on the second magnet, a vibrating plate which is attached at a circumferential portion thereof to the frame and provided over the second magnet and the second top plate, and a second voice coil attached to the vibration plate and inserted in a second magnetic gap formed between the yoke and the second magnet.

2. The acoustic apparatus according to claim 1, wherein the second top plate is connected through a second suspension to frame.

3. The acoustic apparatus according to claim 1, further comprising a first circuit board to which terminals of the first voice coil are connected and a second circuit board to which terminals of the second voice coil are connected.

4. The acoustic apparatus according to claim 1, wherein the vibrating plate is covered by a protector which is fixed to the frame.

5. A communication device in which the acoustic apparatus as recited in claim 1 is installed, wherein the vibration-transmitting panel of the acoustic apparatus is disposed to contact with a vibrating member.

6. The communication device according to claim 5, wherein the communication device is a mobile phone.

7. The communication device according to claim 6, wherein the vibrating member comprises a transparent plate for protecting a liquid crystal display of the mobile phone, and the vibration-transmitting panel of the acoustic apparatus is adhesively connected to the transparent plate.

8. The acoustic apparatus according to claim 1, further comprising a plate which is disposed to be in contact with the vibration-transmitting panel and is provided with a plate to which vibration of the vibration-transmitting panel is transmitted.

* * * * *